United States Patent [19]

Dapperheld et al.

[11] Patent Number: 4,908,107

[45] Date of Patent: Mar. 13, 1990

[54] PROCESS FOR PREPARING FLUORINATED VINYL ETHERS

[75] Inventors: Steffen Dapperheld, Kriftel; Werner Schwertfeger, Langgöns; Manfred Wildt, Brombachtal, all of Fed. Rep. of Germany

[73] Assignee: Hoechst Aktiengesellschaft, Frankfurt, Fed. Rep. of Germany

[21] Appl. No.: 202,127

[22] Filed: Jun. 2, 1988

[30] Foreign Application Priority Data

Jun. 4, 1987 [DE] Fed. Rep. of Germany ..... 3718726

[51] Int. Cl.[4] ..... C25B 3/00

[52] U.S. Cl. ..... 204/59 F; 204/81

[58] Field of Search ..... 204/59 R, 59 F, 73 R, 204/76, 81

[56] References Cited

U.S. PATENT DOCUMENTS

| | | | |
|---|---|---|---|
| 3,132,123 | 5/1964 | Harris et al. | 260/87.5 |
| 4,120,761 | 10/1978 | White | 204/59 R |
| 4,544,458 | 10/1985 | Grot | 204/98 |
| 4,654,128 | 3/1987 | Leroux | 204/59 F |

FOREIGN PATENT DOCUMENTS

| | | |
|---|---|---|
| 0079555 | 5/1983 | European Pat. Off. . |
| 1518510 | 7/1978 | United Kingdom . |
| 2135669 | 9/1984 | United Kingdom . |

OTHER PUBLICATIONS

Anderson, R. F. et al., in Banks, R. E., *Organofluorine Chemicals and Their Industrial Applications*, Ellis Horwood, Ltd., Chichester Eng., 1979, Ch. 12, pp. 235-247.

Millauer, Hans et al., *Agnew. Chem., Int's Ed. Engl.* 24, 161-179, (1985).

*Primary Examiner*—John F. Niebling

*Assistant Examiner*—Isabelle Rodriguez

[57] ABSTRACT

The invention relates to a process for preparing compounds of the formula $$\text{(I)}\ R_1{-}O{-}CF{=}CF_2$$

by elimination of halogen atoms from compounds of the formula $$R_1{-}O{-}\underset{\underset{R_2}{|}}{CF}{-}\underset{\underset{R_3}{|}}{CF_2} \qquad \text{(II)}$$

by electrolysis. The compounds of the formula (II) are electrolyzed in an undivided or divided electrolysis cell in an organic liquid which can also contain water at a temperature from −20° C. to the boiling temperature of the electrolyte or catholyte at a current density of 1-500 mA/cm$^2$ at a cathode made of lead, cadmium, zinc, copper, tin, zirconium, mercury, alloys of these metals or carbon.

19 Claims, No Drawings

PROCESS FOR PREPARING FLUORINATED VINYL ETHERS

Fluorinated vinyl ethers of the formula $R_1—O—CF=CF_2$ (I) are important comonomers for preparing fluorinated resins which have specific properties. Thus, the copolymer of tetrafluoroethylene with perfluoropropyl vinyl ether (in which $R_1$ is $CF_3—CF_2—CF_2—$), in contrast to the pure polytetrafluoroethylene, is thermoplastically processible (US-PS 3,132,123). Perfluoropropyl vinyl ether is prepared by dimerization of hexafluoropropene oxide and pyrolysis of the resulting acid fluoride. Other fluorinated vinyl ethers are prepared analogously (Angewandte Chemie, Internat. Ed. Engl. 24 (1985), 161–179).

By using other vinyl ethers of the formula (I) with $$R_1 = FSO_2—CF_2—CF_2—O—\underset{\underset{CF_3}{|}}{CF}—CF_2— \quad \text{or}$$

$$R_1 = CH_3—O—OC—(CF_2)_n\text{-}[O—\overset{\overset{CF_3}{|}}{CF}—CF_2]_m,$$

in which n is 2 or 3 and m is 0 or 1, perfluorinated ion-exchanger membranes can be obtained. The use of monohydroperfluoroalkyl vinyl ethers of the formula (I) with $$R_1 = H—(CF_2)_n\text{-}[O—\overset{\overset{CF_3}{|}}{CF}—CF_2]_m,$$

in which n is 2–8 and m is 0–2 or with $$R_1 = CF_3—CHF—CF_2—CF_2\text{-}[O—\overset{\overset{CF_3}{|}}{CF}—CF_2]_m,$$

in which m is 0–2, also makes it possible to prepare perfluorinated ion-exchanger resins. (R. E. Banks: Organofluorine Chemicals and their Industrial Applications, Ellis Horwood Ltd., 1979, pp. 235–247). Bromine-containing vinyl ethers of the formula (I) with $R_1=BrCF_2—CF_2—$ are suitable for the synthesis of fluorinated resins which can latter be crosslinked (EP-A1-79,555).

To purify vinyl ethers of the formula (I) it is often advantageous to halogenate the vinyl ether group by means of chlorine or bromine to give compounds of the formula (II):

$$\text{(II)}\ R_1—O—CFR_2—CF_2R_3$$

with $R_2$ and $R_3$=Cl or Br.

Addition of the halogen leads to a higher boiling point so that impurities can be separated off by distillation.

To recover the compounds of the formula (I), the halogen must be eliminated again from the compounds of the formula (II) after purification. In general, this is carried out by means of zinc or other metals which, however, is associated with an unavoidable production of zinc or other metal salts.

It is an object of the invention to carry out the elimination of halogen from compounds of the formula (II) in an industrially practicable and economical process which is not handicapped by the unavoidable production of metal salts. This object is achieved by the present invention. This invention provides a process for preparing compounds of the formula $$\text{(I)}\ R_1—O—CF=CF_2$$

by elimination of halogen atoms from compounds of the formula $$R_1—O—\underset{\underset{R_2}{|}}{CF}—\underset{\underset{R_3}{|}}{CF_2} \qquad \text{(II)}$$

in which $R_1$ is $R_4—CXY—(CF_2)_n—\underset{\underset{R_5}{|}}{CF}\text{-}[O—\overset{\overset{CF_3}{|}}{CF}—CF_2]_m$ with $R_4$ = F, Cl, perfluoroalkyl having 1–3 carbon atoms $R_5$ = F, perfluoroalkyl having 1–3 carbon atoms X = F, Cl, Br, I, H, —O—alkyl, —COO—alkyl, $—SO_2F$ Y = F, Cl, n = 0–10 m = 0–5

$R_2$ = Cl, Br, $R_3$ = Cl, Br, which comprises electrolyzing the compounds of the formula (II) in an undivided or divided electrolysis cell in an organic liquid which can also contain water at a temperature of −20° C. to the boiling temperature of the electrolyte or catholyte at a current density of 1–500 $mA/cm^2$ at a cathode made of lead, cadmium, zinc, copper, tin, zirconium, mercury, alloys of these metals or carbon.

Preferably, n is 0–8, in particular 0–6; m is preferably 0–3, in particular 0–2.

Suitable starting substances are in particular the dichlorides or dibromides of the following vinyl ethers:

$$CF_3—CF_2—CF_2\text{-}[O—\overset{\overset{CF_3}{|}}{CF}—CF_2]_m O—CF=CF_2;$$
m = 0,1

$$H—(CF_2)_n—CF_2\text{-}[O—\overset{\overset{CF_3}{|}}{CF}—CF_2]_m O—CF=CF_2;$$
n = 1,2,4; m = 0,1

$$Br—(CF_2)_n—CF_2\text{-}[O—\overset{\overset{CF_3}{|}}{CF}—CF_2]_m O—CF=CF_2;$$
n = 1,2; m = 0,1

$$CCl_3—CF_2\text{-}[O—\overset{\overset{CF_3}{|}}{CF}—CF_2]_m O—CF=CF_2;$$
m = 0,1

$$CF_3—CHF—CF_2—CF_2\text{-}[O—\overset{\overset{CF_3}{|}}{CF}—CF_2]_m O—CF=CF_2;$$
m = 0,1

$$Cl—(CF_2)_n—CF_2\text{-}[O—\overset{\overset{CF_3}{|}}{CF}—CF_2]_m O—CF=CF_2;$$
m = 0,1; n = 1,2

-continued $$Cl_2CF-CF_2\left[O-\overset{CF_3}{\overset{|}{C}}F-CF_2\right]_m O-CF=CF_2;$$
m = 0,1

$$CH_3OOC-(CF_2)_n-CF_2\left[O-\overset{CF_3}{\overset{|}{C}}F-CF_2\right]_m OCF=CF_2;$$
n = 1,2,; m = 0,1

$$FO_2S-(CF_2)_n-CF_2\left[O-\overset{CF_3}{\overset{|}{C}}F-CF_2\right]_m O-CF=CF_2;$$
n = 1,2,; m = 0,1

The process according to the invention is carried out in divided or undivided cells. To divide the cells into an anode and cathode compartment, the usual diaphragms which are stable in the electrolyte and are made of polymers, preferably perfluorinated polymers, or other organic or inorganic materials such as, for example, glass or ceramic are used. Preferably, ion-exchanger membranes, in particular cation-exchanger membranes made of polymers, preferably perfluorinated polymers having carboxyl and/or sulfo groups are used. The use of stable anion-exchanger membranes is also possible.

The electrolysis can be carried out in all conventional electrolytic cell such as, for example, in beaker or plate and frame cells or cells having fixed bed or fluidized bed electrodes. Both, monopolar and bipolar connection of the electrodes can be used.

It is possible to carry out the electrolysis not only continuously but also batchwise.

The electrolysis can be carried out at any cathode which is stable in the electrolyte. In particular, materials having a medium to high hydrogen overpotential such as, for example, carbon, Pb, Cd, Zn, Cu, Sn, Zr, Hg and alloys of the metals mentioned such as amalgams of copper or lead, but also alloys such as lead-tin or zinc-cadmium can be used. Preference is given to the use of carbon cathodes, in particular in the case of electrolysis in acidic electrolytes. Carbon cathodes which can be used are in general any carbon electrode materials such as, for example, electrode graphites, impregnated graphite materials, carbon felts and also glass-like carbon.

All materials at which the corresponding anode reactions proceed can be used as the anode material. For example, lead, lead dioxide on lead or other supports, platinum, titanium dioxide on titanium doped with noble metal oxides (such as platinum oxide) are suitable for the evolution of oxygen from dilute sulfuric acid. Carbon or titanium dioxide on titanium doped with noble metal oxides are suitable, for example, for the evolution of chlorine from aqueous alkali metal chloride solutions or aqueous or alcoholic hydrogen chloride solutions.

Preferred anolyte liquids are aqueous mineral acids or solutions of their salts such as, for example, diluted sulfuric acid, concentrated hydrochloric acid, sodium sulfate or sodium chloride solutions or solutions of hydrogen chloride in alcohol.

The electrolyte in the undivided cell or the catholyte in the divided cell contains the compound of the formula (II) used and one or more organic solvents and can additionally contain water. Examples of suitable organic solvents are short-chain aliphatic alcohols such as methanol, ethanol, propanol or butanol; diols such as ethylene glycol and propanediol, but also polyethylene glycols and ethers thereof; ethers such as tetrahydrofuran and dioxane; amides such as N,N-dimethylformamide, hexamethylphosphoric triamide and N-methyl-2-pyrrolidone; nitriles such as acetonitrile and propionitrile; ketones such as acetone; and also sulfolane. The use of organic acids such as, for example, acetic acid is also possible.

However, the electrolyte can also be composed of water or of water and an organic solvent which is not water-soluble such as t-butyl methyl ether or methylene chloride in combination with a phase transfer catalyst.

Preferably, salts of metals having a hydrogen overpotential of at least 0.25 V (based on a current density of 300 mA/cm$^2$) and/or dehalogenating properties are added to the electrolyte in the undivided cell or to the catholyte in the divided cell. Suitable such salts are mainly the soluble salts of Cu, Ag, Au, Zn, Cd, Hg, Sn, Pb, Tl, Ti, Zr, Bi, V, Ta, Cr, Ce, Co or Ni, preferably the soluble salts of Pb, Sn, Ag, Zn, Cd, and Cr. The preferred anions of these salts are $Cl^-$, $SO_4^{--}$, $NO_3^-$ and $CH_3COO^-$.

The salts can be added directly or they can also be produced in the solution, for example by addition of oxides, carbonates—in some cases even the metals themselves (if soluble).

The salt concentration in the electrolyte of the undivided cell or in the catholyte of the divided cell is advantageously set at about $10^{-5}$ to 25% by weight, preferably at about $10^{-3}$ to 10% by weight, in each case based on the total amount of the electrolyte or catholyte.

The electrolysis is carried out at a current density from 1 to 500 mA/cm$^2$, preferably at 10 to 400 mA/cm$^2$. The electrolysis temperature is in the range from −20° C. to the boiling temperature of the electrolyte or catholyte, preferably at 10° to 90° C., in particular at 10° to 80° C.

To adjust the pH to values from 0 to 9 which are most favorable for the electrolysis, preferably from 0.5 to 8, and to increase the conductivity, inorganic or organic acids can be added to the catholyte in the divided cell or to the electrolyte in the undivided cell, preferably acids such as hydrochloric acid, boric acid, phosphoric acid, sulfuric acid or tetrafluoroboric acid or formic acid, acetic acid or citric acid or salts thereof.

The addition of organic bases can also be useful for setting the pH which is most favorable for the electrolysis or can favorably influence the course of the electrolysis. Suitable bases are primary, secondary or tertiary $C_2$-$C_{12}$-alkyl- or cycloalkylamines, aromatic or aliphatic-aromatic amines or salts thereof, inorganic bases such as alkali metal or alkaline earth metal hydroxides such as, for example, the hydroxides of Li, Na, K, Cs, Mg, Ca and Ba, quaternary ammonium salts such as the fluorides, chlorides, bromides, iodides, acetates, sulfates, hydrogensulfates, tetrafluoroborates, phosphates or hydroxides of $C_1$-$C_{12}$-tetraalkylammonium, $C_1$-$C_{12}$-trialkylarylammonium or $C_1$-$C_{12}$-trialkylalkylarylammonium, but also anion-active or cation-active emulsifiers, in amounts from 0.01 to 25 percent by weight, preferably 0.03 to 20 percent by weight, based on the total amount of the electrolyte or catholyte.

In the case of the electrolysis in an undivided cell, compounds can be added to the electrolyte which are oxidized at a more negative potential than the halogen ions liberated to prevent the formation of free halogen. Suitable compounds are, for example, the salts of oxalic acid, methoxyacetic acid, glyoxylic acid, formic acid and/or hydrogen azide.

The workup of the electrolysis product is carried out in a known manner, for example by extraction or by distilling off the solvent. The compounds added to the catholyte can thus be recycled into the process.

EXAMPLES

The examples were carried out in electrolytic cells defined as follows:

Electrolytic cell 1:

Jacketed glass pot cell having a volume of 350 ml; anode: platinum wire, graphite or lead plate (20 $cm^2$); cathode area: 12 $cm^2$; distance between electrodes: 1.5 cm;

anolyte: dilute aqueous sulfuric acid or methanolic hydrochloric acid; cation-exchanger membrane: double-layer membrane made of a copolymer from a perfluorosulfonylethoxyvinyl ether and tetrafluoroethylene; material transport: by magnetic stirrer.

Electrolytic cell 2: as electrolytic cell 1, with the following modifications: jacketed glass pot circulation cell having a volume of 450 ml; distance between electrodes: 1 cm; throughflow: 360 l/h.

EXAMPLE 1

The reaction was carried out in electrolysis cell 2. The starting electrolyte contained 250 ml of methanol, 10 g of $Na(OOC—CH_3)$, 0.4 g of $Pb(OOC—CH_3)_2$ and 100 g of $$H—(CF_2)_3—O—\underset{\underset{CF_3}{|}}{CF}—CF_2—O—\underset{\underset{Br}{|}}{CF}—\underset{\underset{Br}{|}}{CF_2}.$$

The electrolysis was carried out using a cathode made of electrode graphite at a current density of 166 mA/$cm^2$, a terminal voltage of 32–16 V, a temperature of 34°–36° C., a current consumption of 12.66 Ah and a pH of 7.85 down to less than 0.

Result of the electrolysis: 62.75 g (84%) of $$H—(CF_2)_3—O—\overset{\overset{CF_3}{|}}{CF}—CF_2—O—CF{=}CF_2,$$

after extraction with pentane and distilling off the pentane.

EXAMPLE 2

The reaction was carried out in electrolytic cell 1. The starting electrolyte contained 100 ml of methanol, 1 ml of concentrated hydrochloric acid and 20 g of $$CF_3—CF_2—CF_2—O—\underset{\underset{CF_3}{|}}{CF}—CF_2—O—\underset{\underset{Br}{|}}{CF}—CF_2Br.$$

The electrolysis was carried out using a cathode made of impregnated graphite at a current density of 83-42 mA/$cm^2$, a terminal voltage of 20–8 V, a temperature of 30° and a current consumption of 3.15 Ah.

Result of the electrolysis: 11.2 g (77%) of $$CF_3CF_2—CF_2—O—\underset{\underset{CF_3}{|}}{CF}—CF_2—O—CF{=}CF_2$$

after extraction with pentane and distilling off the pentane.

EXAMPLE 3

The reaction was carried out in electrolytic cell 1. The starting electrolyte contained 100 ml of methanol, 0.6 g of $CrCl_3$, 2 ml of concentrated hydrochloric acid and 20 g of $$CF_3—CF_2—CF_2—\underset{\underset{Br}{|}}{O}—CF—CF_2Br.$$

The electrolysis was carried out using a cathode made of impregnated graphite at a current density of 42 mA/$cm^2$, a terminal voltage of 6.5 V, a temperature of 30°–40° and a current consumption of 4 Ah.

The reaction product $CF_3—CF_2—CF_2—O—CF{=}CF_2$ was distilled off continuously during the electrolysis. A second distillation gave 6.7 g (54%) of $CF_3—CF_2—CF_2—O—CF{=}CF_2$ (boiling point 36° C.).

EXAMPLE 4

The reaction was carried out in electrolytic cell 1. The starting electrolyte contained 100 ml of ethanol, 0.5 g of $Pb(OOCCH_3)_2$, 5 g of $Na(OOCCH_3)$, 2 g of $(CH_3)_4N^+Cl^-$ and 17.4 g of $H—CF_2—CF_2—O—CF—Br—CF_2Br$. The electrolysis was carried out using a cathode made of impregnated graphite at a current density of 83 mA/$cm^2$, a terminal voltage of 15–9 V, a temperature of 40°–46° C. and a current consumption of 7.2 Ah.

Result of the electrolysis: 6.95 g of $HCF_2—CF_2—O—CF{=}CF_2$ (78.1%), boiling point 32° C.

EXAMPLE 5

The reaction was carried out in electrolytic cell 1. The starting electrolyte contained 250 ml of methanol, 10 g of $Na(OOCCH_3)$, 0.4 g of $Pb(OOCCH_3)_2$ and 100 g of $$H(CF_2)_3—O—\underset{\underset{Br}{|}}{CF}—\underset{\underset{Br}{|}}{CF_2}.$$

The electrolysis was carried out using a cathode made of impregnated graphite at a current density of 166 mA/$cm^2$, a terminal voltage of 37–15 V, a temperature of 32°, a current consumption of 16 Ah and a pH of 7.65–0.2.

Result of the electrolysis: 46.4 g (76.4%) of $H—(CF_2)_3—O—CF{=}CF_2$ after extraction with $CF_2Cl—CFCl_2$ and distilling off the solvent.

EXAMPLE 6

The reaction was carried out in electrolytic cell 1. The starting electrolyte contained 200 ml of methanol, 5 g of $Na(OOCCH_3)$, 0.5 g of $AgNO_3$ and 20 g of $$CH_3—O—CO—CF_2—CF_2—O—\overset{\overset{Cl}{|}}{CF}—\overset{\overset{Cl}{|}}{CF_2}.$$

The electrolysis was carried out using a cathode made of impregnated graphite at a current density of 83.3 mA/$cm^2$, a terminal voltage of 11–8.5 V and a temperature of 30°. At the beginning, the pH was 8.0; during the course of the electrolysis, the pH was kept in the range between 6.7 and 4.4 by addition of 3 g of $NaOCH_3$. The current consumption was 13.12 Ah.

Result of the electrolysis: 0.48 g of $$CH_3O-CO-CF_2-CF_2-O-\underset{Cl}{\underset{|}{CF}}-\underset{Cl}{\underset{|}{CF_2}},$$

0.62 g (4.3%) of $CH_3O-CO-CF_2-CF_2-OCF=CF_2$ after extraction with pentane and distilling off the solvent. The remaining methanolic solution was acidified to pH 1 using $H_2SO_4/H_2O$ and extracted using diethyl ether. After distilling off the solvent, 4.06 g of $$HOCO-CF_2CF_2-O-\underset{Cl}{\underset{|}{CF}}-\underset{Cl}{\underset{|}{CF_2}}$$

7.02 g (61.7%) of $HOCO-CF_2CF_2-O-CF=CF_2$ were obtained.

EXAMPLE 7

The reaction was carried out in electrolytic cell 1. The starting electrolyte contained 200 ml of DMF, 5 g of $(CH_3)_4NO_3SOCH_3$ and 20 g of $$FSO_2-(CF_2)_2-O-\underset{CF_3}{\underset{|}{CF}}-CF_2-O-\underset{Br}{\underset{|}{CF}}-\underset{Br}{\underset{|}{CF_2}}.$$

The electrolysis was carried out using a cathode made of sheet lead at a current density of 88 mA/cm$^2$, a terminal voltage of 29–18 V, a temperature of 32° C. and a current consumption of 1.76 Ah.

Result of the electrolysis:

8.84 g (64.1%) of $$FSO_2-(CF_2)_2-O-\underset{CF_3}{\underset{|}{CF}}-CF_2-O-CF=CF_2$$

1.81 g of $$FSO_2-(CF_2)_2-O-\underset{CF_3}{\underset{|}{CF}}-CF_2-O-\underset{Br}{\underset{|}{CF}}-CF_2Br.$$

EXAMPLE 8

The reaction was carried out in electrolytic cell 1. The starting electrolyte contained 100 ml of DMF, 0.5 g of $AgNO_3$, 3 g of $(CH_3)_4NO_3SOCH_3$ and 20 g of $$FSO_2-(CF_2)_2-O-\underset{CF_3}{\underset{|}{CF}}-CF_2-O-\underset{Br}{\underset{|}{CF}}-CF_2Br.$$

The electrolysis was carried out using a cathode made of impregnated graphite at a current density of 88 mA/cm$^2$, a terminal voltage of 28–17 V, a temperature of 30° and a current consumption of 1.76 Ah.

Result of the electrolysis:

1.8 g of $$FSO_2-(CF_2)_2-O-\underset{CF_3}{\underset{|}{CF}}-CF_2-O-\underset{Br}{\underset{|}{CF}}-CF_2Br$$

11.7 g (87.6%) of $$FSO_2(CF_2)_2-O-\underset{CF_3}{\underset{|}{CF}}-CF_2-O-CF=CF_2$$

EXAMPLE 9

The reaction was carried out in electrolytic cell 1. The starting electrolyte contained 100 ml of methanol, 5 g of $CH_3COONa$, 0.5 g of $(CH_3COO)_2Pb$ and 10 g of $CCl_3-CF_2-O-CFBr-CF_2Br$. The electrolysis was carried out using a cathode made of impregnated graphite at a current density of 88 mA/cm$^2$, a terminal voltage of 28–13 V, a temperature of 32° and a current consumption of 1.26 Ah.

Result of the electrolysis:

| | | |
|---|---|---|
| $Cl_3C-CF_2-O-CF=CF_2$ | 2.795 g | (50%) |
| $Cl_2CH-CF_2-O-CF=CF_2$ | 0.545 g | (9%) |

We claim:

1. A process for preparing compounds of the formula (I) $R_1-O-CF=CF_2$ by elimination of halogen atoms from compounds of the formula $$R_1-O-\underset{R_2}{\underset{|}{CF}}-\underset{R_3}{\underset{|}{CF_2}} \qquad \text{(II)}$$

in which $R_1$ is $$R_4-CXY-(CF_2)_n-\underset{R_5}{\underset{|}{CF}}\left[O-\overset{CF_3}{\overset{|}{CF}}-CF_2\right]_m$$

with $R_4$ = F, Cl, perfluoralkyl having 1–3 carbon atoms
X = F, Cl, Br, I, H, —O—alkyl, —COO—alkyl, $-SO_2F$
Y = F, Cl,
n = 0–10
m = 0–5
$R_2$ = Cl, Br,
$R_3$ = Cl, Br, which comprises electrolyzing the compounds of the formula (II) in an undivided or divided electrolysis cell in an organic liquid which can also contain water at a temperature of −20° C. to the boiling temperature of the electrolyte or catholyte at a current density of 1–500 mA/cm$^2$ at a cathode composed of lead, cadmium, zinc, copper, tin, zirconium, mercury, alloys of these metals or carbon.

2. The process as claimed in claim 1, wherein the electrolysis is carried out at a pH from 0 to 9 in the electrolyte in the undivided cell or in the catholyte in the divided cell.

3. The process as claimed in claim 1, wherein the dichlorides or dibromides of the following vinyl ethers:

$$CF_3-CF_2-CF_2\left[O-\overset{CF_3}{\overset{|}{C}F}-CF_2\right]_mO-CF=CF_2;$$
m = 0,1

$$H-(CF_2)_n-CF_2\left[O-\overset{CF_3}{\overset{|}{C}F}-CF_2\right]_mO-CF=CF_2;$$
n = 1, 2, 4; m = 0,1

$$Br-(CF_2)_n-CF_2\left[O-\overset{CF_3}{\overset{|}{C}F}-CF_2\right]_mO-CF=CF_2;$$
n = 1, 2; m = 0,1

$$CCl_3-CF_2\left[O-\overset{CF_3}{\overset{|}{C}F}-CF_2\right]_mO-CF=CF_2;$$
m = 0,1

$$CF_3-CHF-CF_2-CF_2\left[O-\overset{CF_3}{\overset{|}{C}F}-CF_2\right]_mO-CF=CF_2;$$
m = 0,1

$$Cl-(CF_2)_n-CF_2\left[O-\overset{CF_3}{\overset{|}{C}F}-CF_2\right]_mO-CF=CF_2;$$
m = 0,1; n = 1,2

$$Cl_2CF-CF_2\left[O-\overset{CF_3}{\overset{|}{C}F}-CF_2\right]_mO-CF=CF_2;$$
m = 0,1

$$CH_3OOC-(CF_2)_n-CF_2\left[O-\overset{CF_3}{\overset{|}{C}F}-CF_2\right]OCF=CF_2;$$
n = 1,2; m = 0,1

$$FO_2S-(CF_2)_n-CF_2\left[O-\overset{CF_3}{\overset{|}{C}F}-CF_2\right]_mO-CF=CF_2;$$
n = 1,2; m = 0,1 are electrolyzed.

4. The process as claimed in claim 1, wherein the electrolysis is carried out at a temperature from 10° to 90° C.

5. The process as claimed in claim 1, wherein the electrolysis is carried out at a current density from 10 to 400 mA/cm$^2$.

6. The process as claimed in claim 1, wherein the electrolysis is carried out using a carbon cathode.

7. The process as claimed in claim 1, wherein a soluble salt of copper, silver, gold, zinc, cadmium, mercury, tin, lead, thallium, titanium, zirconium, bismuth, vanadium, tantalum, chromium, cerium, cobalt or nickel is added in a concentration of $10^{-3}$ to 10% by weight to the electrolyte in the undivided cell or to the catholyte in the divided cell.

8. The process as claimed in claim 1, wherein for said formula II, n ranges from 0–8, and m ranges from 0–3.

9. The process as claimed in claim 1, wherein for said formula II, n ranges from 0–6, and m ranges from 0–2.

10. The process as claimed in claim 1, wherein a compound of formula (II) is electrolyzed in a divided electrolysis cell, said divided cell being divided by a membrane of perfluorinated polymers, glass, ceramic, perfluorinated polymers having carboxyl, perfluorinated polymers having sulfo groups, or perfluorinated polymers having carboxyl and sulfo groups.

11. The process as claimed in claim 1, wherein a compound of formula (II) is electrolyzed in a cell which includes an anode composed of lead, lead dioxide on a support, platinum, titanium dioxide on titanium doped with noble metal oxide, or carbon.

12. The process as claimed in claim 1, wherein a compound of formula (II) is electrolyzed in a divided or undivided cell to which a soluble salt of copper, silver, gold, zinc, cadmium, mercury, tin, lead, thallium, titanium, zirconium, bismuth, vanadium, tantalum, chromium, cerium, cobalt or nickel is added in a concentration ranging from $10^{-5}$ to 25% by weight of the electrolyte in the undivided cell or of the catholyte in the divided cell.

13. The process as claimed in claim 1, wherein the electrolysis is carried out at a current density from 1 to 500 mA/cm$^2$.

14. The process as claimed in claim 4, wherein the electrolysis is carried out at a temperature ranging from 10° to 80° C.

15. The process as claimed in claim 2, wherein the electrolysis is carried out at a pH ranging from 0.5 to 8 in the electrolyte in the undivided cell, or in the catholyte in the divided cell.

16. The process as claimed in claim 2, wherein said pH is controlled by the addition of an organic base of primary, secondary, or tertiary $C_2$-$C_{12}$-alkyl- or cycloalkylamines, aromatic or aliphatic-aromatic amines or salts thereof or an inorganic base of alkali metal, alkaline earth metal, hydroxides, quaternary ammonium salts, hydroxides of $C_1$-$C_{12}$-tetraalkyl-ammonium, $C_1$-$C_{12}$-trialkylarylammonium, $C_1$-$C_{12}$-trialkylalkylarylammonium, or an emulsifier that is anion- or cation-active in concentrations ranging from 0.01 to 25% by weight of the electrolyte or catholyte.

17. The process as claimed in claim 16, wherein the concentration of said organic base, inorganic base, or emulsifier ranges from 0.03 to 20% by weight of the electrolyte or catholyte.

18. The process as claimed in claim 2, wherein said pH is controlled by the addition of an inorganic or organic acid of hydrochloric acids, boric acid, phosphoric acid, sulfuric acid, tetrafluoroboric acid, formic acid, acetic acid, citric acid or a salt thereof, to the catholyte in the divided cell, or to the electrolyte in the undivided cell.

19. The process as claimed in claim 1, wherein the electrolysis is carried out in an undivided cell, and a salt of oxalic acid, methoxyacetic acid, glyoxylic acid, formic acid, hydrogen azide, or salts of formic acid and hydrogen azide has or have been added to the electrolyte of the undivided cell.

* * * * *

UNITED STATES PATENT AND TRADEMARK OFFICE

CERTIFICATE OF CORRECTION

PATENT NO. : 4,908,107

DATED : March 13, 1990

INVENTOR(S) : DAPPERHELD, ET AL.

It is certified that error appears in the above-identified patent and that said Letters Patent is hereby corrected as shown below:

In claim 1, line 12 (Col. 8, line 48) after "carbon atoms", please insert

-- , $R_5$ = F, perfluoroalkyl having 1-3 carbon atoms, -- .

Signed and Sealed this Ninth Day of July, 1991

*Attest:*

*Attesting Officer*

HARRY F. MANBECK, JR.

*Commissioner of Patents and Trademarks*